US006155795A

United States Patent [19]

Schmalz et al.

[11] Patent Number: 6,155,795

[45] Date of Patent: Dec. 5, 2000

[54] EJECTOR

[75] Inventors: Kurt Schmalz, Dornstetten; Ralf Stockburger, Glatten; Thomas Eisele, Fluorn-Winzeln, all of Germany

[73] Assignee: J. Schmalz GmbH, Glatten, Germany

[21] Appl. No.: 09/270,672

[22] Filed: Mar. 16, 1999

[30] Foreign Application Priority Data

Mar. 20, 1998 [DE] Germany ..... 198 12 275

[51] Int. Cl.[7] ..... F04F 5/00

[52] U.S. Cl. ..... 417/151

[58] Field of Search ..... 417/151, 187, 417/189, 174, 186, 188, 150; 294/65, 64

[56] References Cited

U.S. PATENT DOCUMENTS

| | | | |
|---|---|---|---|
| 3,716,307 | 2/1973 | Hansen | 417/191 |
| 3,967,849 | 7/1976 | Cagle | 294/64.2 |
| 4,432,701 | 2/1984 | Ise . | |
| 5,205,717 | 4/1993 | Tell | 417/189 |
| 5,683,227 | 11/1997 | Nagai et al. | 417/174 |
| 6,024,392 | 2/2000 | Blatt | 294/64.1 |

FOREIGN PATENT DOCUMENTS

| | | |
|---|---|---|
| 1973 433 | 11/1967 | Germany . |
| 2429421C2 | 12/1981 | Germany . |
| 2457316C2 | 7/1986 | Germany . |
| 4302951C1 | 5/1994 | Germany . |
| 19522741A1 | 1/1997 | Germany . |
| 19609826A1 | 9/1997 | Germany . |
| 3818380C2 | 9/1997 | Germany . |

OTHER PUBLICATIONS

Patent Abstract of Japan, M–1300, Aug. 24, 1992, vol. 16/No. 399, Ejector Device 4–132900.

*Primary Examiner*—Teresa Walberg
*Assistant Examiner*—Vinod D Patel
*Attorney, Agent, or Firm*—Jones, Tullar & Cooper, P.C.

[57] ABSTRACT

An ejector for generating a vacuum, with a housing, a propellant nozzle having a narrowed part, a diffuser section, a suction connector terminating in the narrowed part, as well as an exhaust air conduit for the pressure gas and the exhausted air, a simple construction is achieved in that the housing of the ejector is designed as a sectional support for at least two propellant nozzles.

15 Claims, 4 Drawing Sheets

EJECTOR

FIELD OF THE INVENTION

The present invention relates to an ejector for generating a vacuum, with a housing, with a propellant nozzle having a narrowed part, a diffuser section, a suction connector terminating in the narrowed part, as well as an exhaust air conduit for the pressure gas and the exhausted air.

BACKGROUND OF THE INVENTION

Such ejectors are known, for example, from German Patent DE 43 02 951 C1, and operate in accordance with the Venturi principle. The pressure gas, compressed air as a rule, which is filtered and free of lubricant, flows through a connector into the ejector and reaches the propellant nozzle, in which the flow speed of the air is increased to supersonic speed in the narrowed part. Following the exit from the propellant nozzle, the air is expanded and flows into the diffuser, and from there into the open, possibly via a muffler. In the process a vacuum is created in the chamber surrounding the propellant nozzle, which results in air being aspirated via the suction connector. The aspirated air and the propellant introduced into the jet pump move into the open together via an expansion section.

In comparison with other vacuum pumps, such ejectors have the advantage of having no rotating parts and therefore have low maintenance and wear properties. They are furthermore explosion- protected, since they are of a purely pneumatic nature. They moreover are of simple construction and can be installed in any desired position. They do not generate heat and can be switched in, or respectively out, at any time, which results in energy savings. It is furthermore possible to build up the vacuum more quickly because of the short lengths of the lines between the suction gripper and the ejector. Finally, the compact construction, the low weight and the option of combining several functions in one apparatus have a great importance in the fields of ready-made clothes, work preparation, sales, mechanical processing, assembly, startup and spare parts supply.

When grasping larger components, several suction grippers are employed as a rule, which may be connected together into one ejector. However, several injectors are usually employed for this. These several ejectors are combined, for example in a sandwich construction, into a unit. Several vacuum circuits can be formed by means of this unit. However, it has been shown that disadvantages have occurred in spite of the use of these ejectors, since the ejectors continue to be connected with the suction grippers by means of hose assemblies, and the ejectors, in particular the shut-off valves contained in them, must be actuated via electric lines. Both the hose assemblies and the electric lines have interfering effects and possibly hinder the grasping of the object to be transported. The construction as well as the maintenance of such units is relatively elaborate, or respectively cumbersome, since the ejectors must either be directly connected with each other via seals, or spacers are interposed between the ejectors, and the entire unit must be disassembled in case of repairs or maintenance. Such units are moreover relatively expensive, since additional components, such as seals, connecting elements, etc. are required besides the individual complete ejectors.

FIELD OF THE INVENTION

The present invention has as an object making available an ejector of the type mentioned at the outset, which has a simpler construction.

In accordance with the present invention this object is attained in that the housing of the ejector is designed as a support, in particular as a sectional support for at least two propellant nozzles.

By means of the design in accordance with the present invention of the housing of the ejector as a section support, the essential advantage is achieved that for one, the housing can be produced relatively inexpensively, and for another the sectional support can be equipped with any arbitrary number of propellant nozzles. For example, if a unit with five ejectors is needed, the sectional support of the present invention is equipped with five propellant nozzles, so that this sectional support now constitutes the desired unit.

The sectional support in particular is an extruded section, which can be cut to size to the desired length. This extruded section can have the receivers for the propellant nozzles arranged in a grid pattern. However, the receivers can also be cut in at the desired locations in the form of bores, so that the unit is designed in accordance with the wishes of the customer. If the extruded section has receivers in a grid pattern, the receivers which are not needed can be closed by means of a plug. Extruded sections have the essential advantage that they can be produced relatively inexpensively, can have almost any arbitrary length, and can be integrated into all required flow conduits. In addition, the extruded section can be used as a holder for further components, for flow control valves or check valves, sensors, monitoring elements and the like.

A considerable advantage of the present invention is considered to be that for one, no hose assemblies for supplying the ejectors with compressed air are needed, and that the electric lines for actuating the electric components can be housed in the sectional support, so that neither the electric lines nor the hose assemblies have an interfering effect. It is considered to be a further advantage that such sectional supports have a simple structure, but still show great rigidity, or respectively are very sturdy.

In accordance with a preferred embodiment, the sectional support has at least one conduit, in particular a compressed air conduit. This compressed air conduit can be pneumatically connected via a connecting conduit having a check valve with a work conduit, which is connected with the propellant nozzle. It is possible in this way by opening the check valve to supply the work conduit with compressed air, by means of which the desired vacuum can be generated via the propellant nozzle. The check valve is closed when the desired vacuum has been reached, or if the propellant nozzle is not in use.

A further development, or respectively an alternative, provides that the sectional support has a blowoff conduit, and that the blowoff conduit is pneumatically connected with the exhaust air conduit by means of a check valve, in particular a slide. If this check valve is closed, the air present at the propellant nozzle is exhausted from the suction connector via the narrowed part, since it cannot escape via the exhaust air conduit. By blowing the compressed air out of the suction connector, the aspirated object can be released relatively quickly from the suction gripper, which is expressed by the technical term "blowing off".

A variation provides that the sectional support can be divided by means of cut-off plugs for the conduits into discrete sections, which can be individually actuated. In this way it is possible to aspirate several objects and to manipulate them independently of each other by means of a single sectional support. In this case the individual propellant nozzles are connected via different check valves to a common compressed air conduit in this embodiment.

A further development provides that a sensor which detects a vacuum is provided which, as a function of the detected vacuum, connects the propellant nozzle with the compressed air conduit. The vacuum prevailing in the suction gripper is detected by means of this sensor, and the connection to the compressed air conduit is interrupted, if the desired vacuum prevails in the suction gripper, i.e. if the object has been aspirated. Compressed air can be saved in this way. If the vacuum in the suction gripper drops, which can be the case when aspirating objects with uneven surfaces, or in case of damaged suction grippers, for example, the connection is automatically reestablished.

An advantageous embodiment of the present invention provides that the sectional support is designed as a support beam for suction grippers connected with the suction connector. In accordance with a preferred exemplary embodiment, the suction grippers are screwed into the support beam and therefore directly connected with the suction connector. In this exemplary embodiment the sectional support is used as a suction cross bar, by means of which the objects to be grasped are directly aspirated and manipulated.

A muffling device, in particular a foam material, is preferably provided in the exhaust air conduit. This foam material, for example in the shape of molded parts such as coils and the like, can be directly inserted into the exhaust air conduit, because of which the noise of the exhausted air is already muffled in the exhaust air conduit. Possibly no external muffler will be required at the outlet of the exhaust air conduit.

Further advantages, characteristics and details of the present invention ensue from the claims as well as the following description, in which particularly preferred exemplary embodiments are described, making reference to the drawings. Here, the characteristics represented in the drawings and mentioned in the specification and the claims can be important for the present invention respectively individually or in arbitrary combination.

DESCRIPTION OF THE PREFERRED EMBODIMENTS

Figure 1:
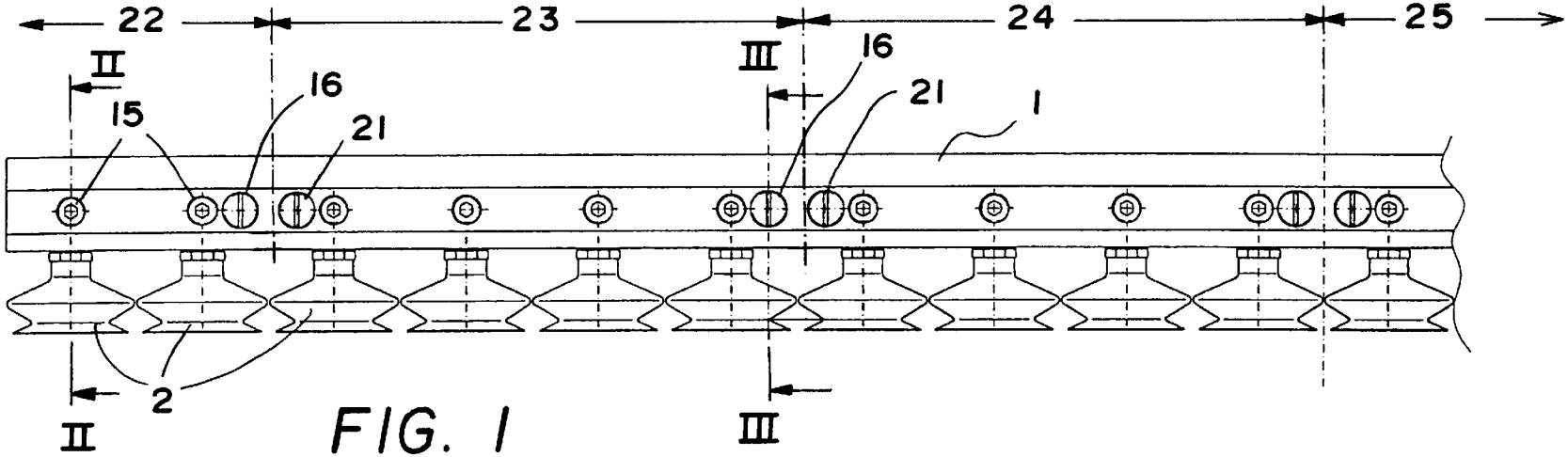
FIG. 1, is a lateral view of the sectional support of the present invention in accordance with a first embodiment with suction grippers provided thereon.
Figure 2:
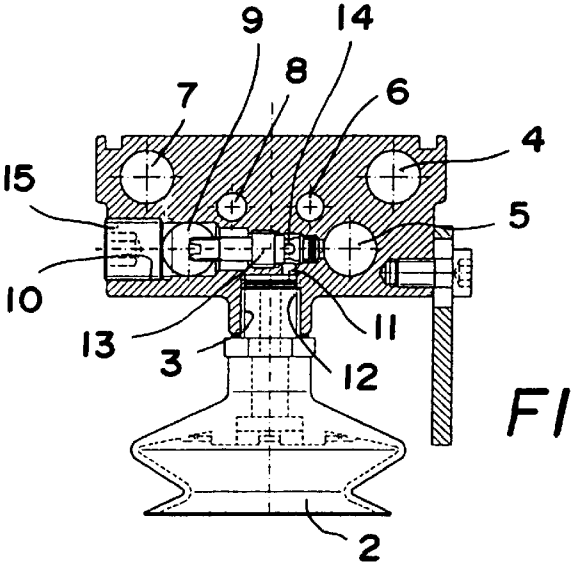
FIG. 2, is a section view along lines II—II in accordance with FIG. 1 through the sectional support, showing the propellant nozzle.

FIG. 1 represents a lateral view of a support beam 1, on whose underside a plurality of suction grippers 2 are fastened. As represented in FIG. 2, these suction grippers 2 have been screwed into appropriate receivers 3 of the support beam 1. This support beam 1 has been produced in the form of an extruded section and has a compressed air conduit 4, a work conduit 5, a blowoff conduit 6, an exhaust air conduit 7, two conduits 8 and 9, as well as a stepped bore 10 extending orthogonally with respect to the conduits 4 to 9. The stepped bore 10 intersects the conduits 5 to 9. The stepped bore 10 is furthermore connected via a connecting conduit 11 with the suction connector 12 having the receiver 3.

A propellant nozzle 13 (propellant and receiver nozzle), which has a narrowed part 14 connected with the connecting conduit 11, is located in the stepped bore 10. This propellant nozzle 13, as well as the stepped bore 10, together with the connecting conduit 11 constitute an ejector. If overpressure is applied to the work conduit 5, compressed air flows through the stepped bore 10 in the direction toward the conduit 9 and in the process flows through the propellant nozzle 13. A vacuum in the connecting conduit 11 is generated in a known manner by the gas flowing through the propellant nozzle 13, so that air is aspirated via the suction grippers 2.

Figure 3:
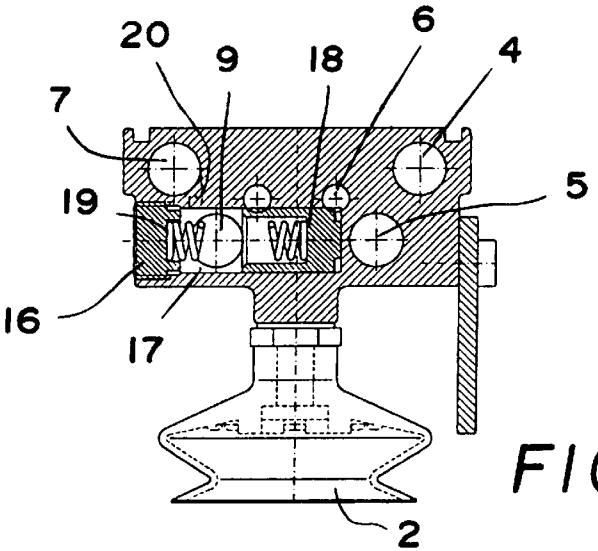
FIG. 3, is a section view along lines III—III in accordance with FIG. 1 through the sectional support, showing a check valve for a connecting conduit to the exhaust air conduit.

Each stepped bore 10 is closed off on its front face by means of a plug 15, which can be seen in FIG. 1. All stepped bores 10 terminate in the conduit 9 as well as in the work conduit 5. Plugs 16 can furthermore be seen in FIG. 1, which close off the front face of a further stepped bore 17. A piston 18 is displaceably arranged in this stepped bore 17, which can be pushed into the flow cross section of the conduit 9*i*. In FIG. 3, the piston 18 is in its position of rest, in which it is maintained by a pressure spring 19. The piston 18 is moved out of this position of rest when an overpressure is applied to the conduit 9, which moves the piston 18 in the direction toward the plug 16. The pressure spring 19 is compressed by this and the piston 16 is pushed over the flow cross section of the conduit 9, so that the conduit 9 is blocked. In addition, the piston 18 is pushed in front of the opening of an overflow conduit 20, so that the inflow opening to the exhaust air conduit 7 is closed. With the conduit 9 blocked and the exhaust air conduit 7 closed, the compressed air flowing through the propellant nozzle 13 can no longer escape, so that it is blown off via the suction connector 12 and the suction grippers 2. This is used in order to be able to quickly release the grasped objects from the suction grippers 2 for the purpose of depositing them. Plugs 21 can also be seen in FIG. 1, by means of which the piston 18 is maintained in the associated step bore 17. With this embodiment it is possible to aspirate several objects together and to again deposit them together.

Figure 4:
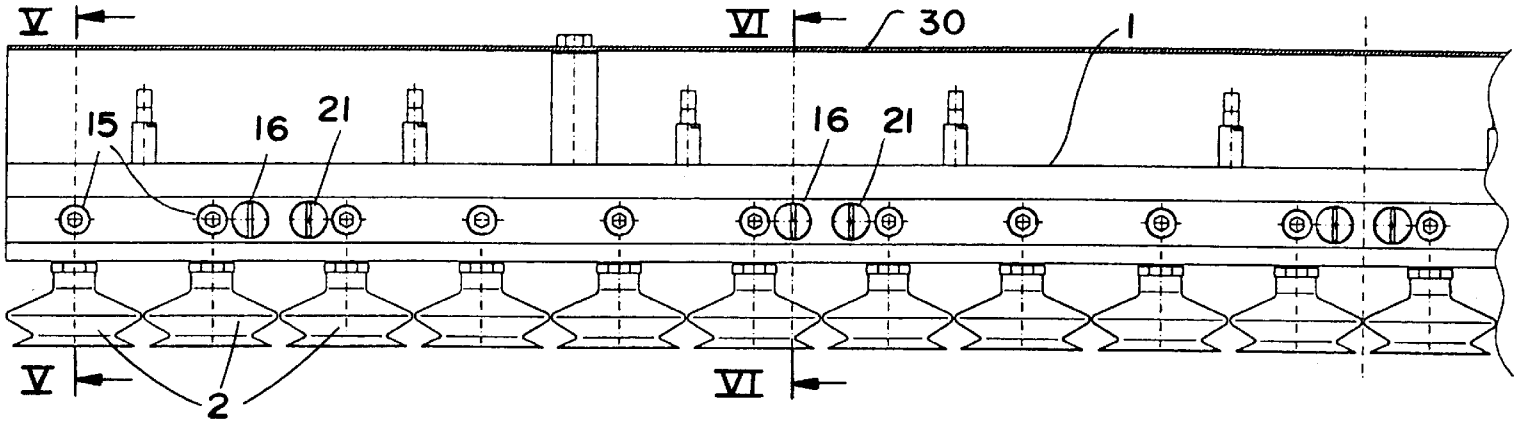
FIG. 4, is a lateral view of the sectional support in accordance with a second embodiment.
Figure 6:
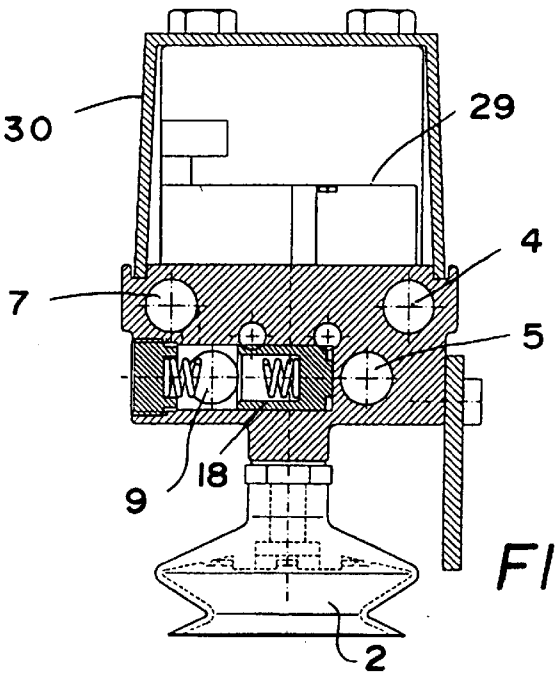
FIG. 6, is a section view along lines VI—VI through the sectional support.
Figure 5:
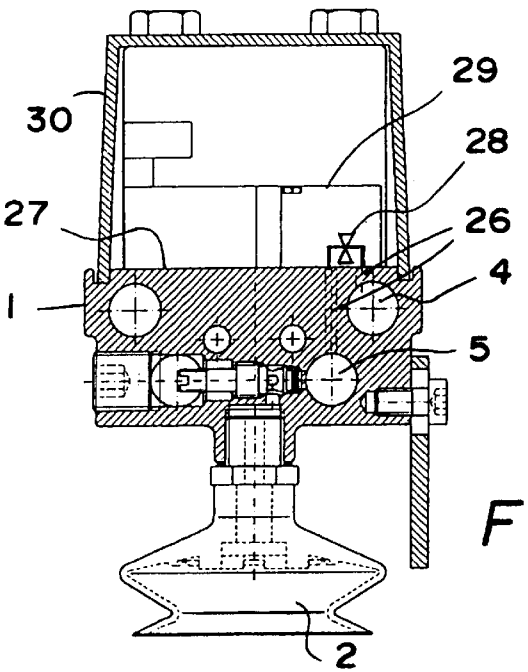
FIG. 5, is a section view along lines V—V in accordance with FIG. 4 through the sectional support.

FIGS. 4–6 show a support beam 1 of a second embodiment, wherein the compressed air conduit 4 and the work conduit 5 are connected with each other via a connecting line 26, which is constituted by two conduit sections, which terminate at the surface 27 of the support beam 1. The two conduit sections of the connecting line 26 are connected with each other via a check valve 28, which has been placed in the form of a module 29 on the surface 27 of the support beam 1. In this way it is possible to apply the overpressure prevailing in the compressed air conduit 4 to the work conduit 5 by opening the check valve 28. If this work conduit 5 is blocked by means of appropriate cut-off plugs, it is possible to divide the support beam 1 into discrete sections by combining several suction grippers 2. In this way an opportunity is provided which makes it possible to grasp several objects, independently of each other, with each section, which can be individually actuated. In this variation, blowing-off, which is required for depositing the objects, takes place jointly for all suction grippers. The modules 29 are protected, particularly against damage, by a hood 30.

Figure 7:
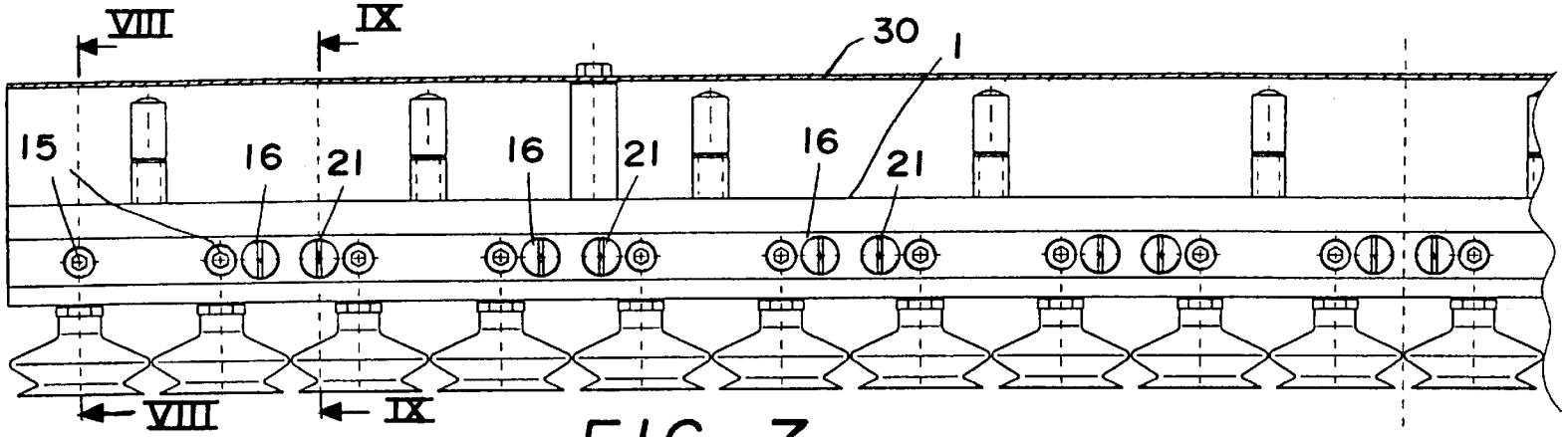
FIG. 7, is a lateral view of the sectional support in accordance with a third embodiment.
Figure 9:
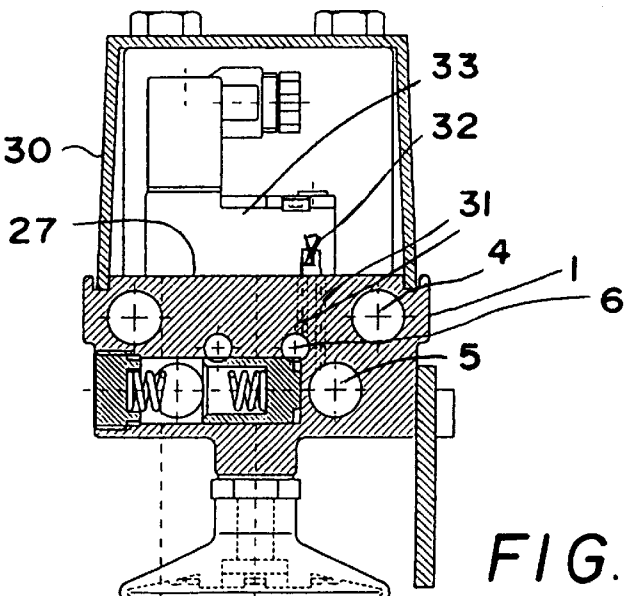
Figure 8:
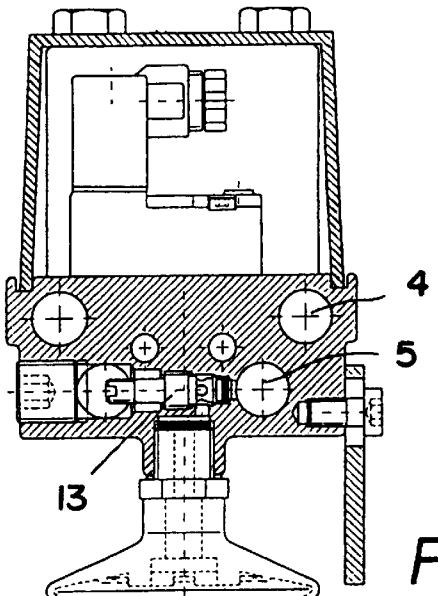
FIG. 8, is a section view along lines VIII—VIII through the sectional support in accordance with FIG. 7, FIG. 9, is a section view along lines IX—IX through the sectional support in accordance with FIG. 7, FIG. 10, is a lateral view of the sectional support in accordance with a fourth embodiment.

A lateral view of a third embodiment of the support beam 1 is represented in FIG. 7, wherein the work conduit 5 is connected via a connecting line 31, formed by two conduit sections which terminate at the surface 27 of the support beam 1, with the blow-off conduit 6, the same way as represented in FIG. 9. The two conduit sections of the connecting line 31 are connected with each other via a check valve 32, through which the connection between the two conduits 5 and 6 can be made, or respectively interrupted. The blowoff conduit 6 is furthermore divided into discrete sections by suitable cut-off plugs, so that it is possible to deposit the objects on the suction grippers located in these sections in a purposeful manner. The check valve 32 is located in a module 33, wherein the modules are protected by a hood 30 in this embodiment, too. By means of the support beam 1 in accordance with this embodiment it is possible to simultaneously grasp objects and to deposit them independently of each other.

Figure 10:
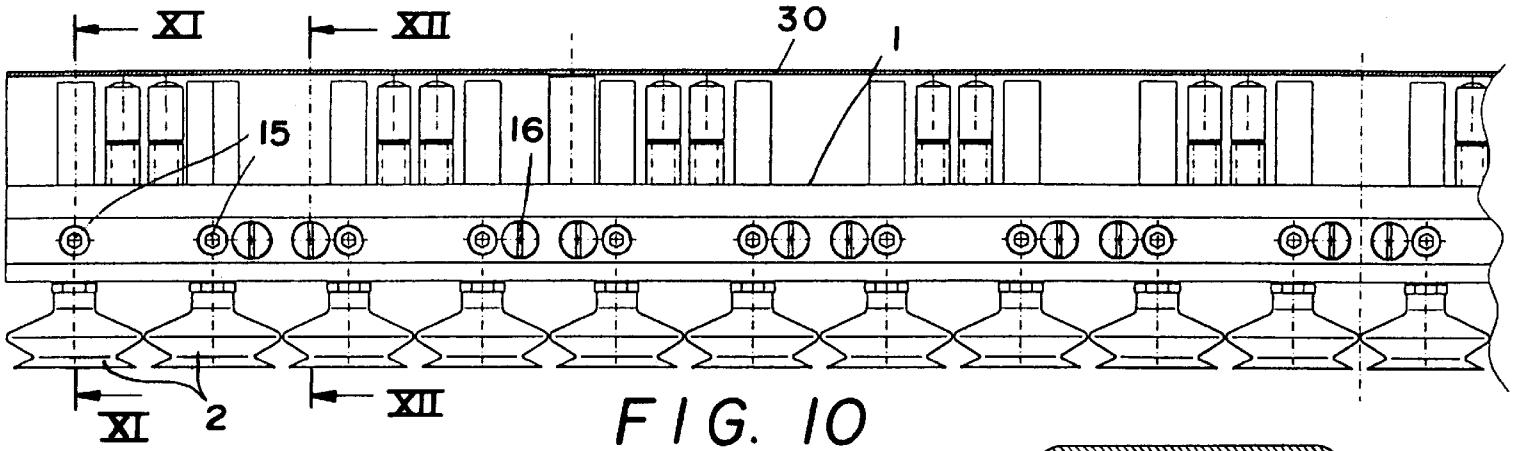
Figure 12:
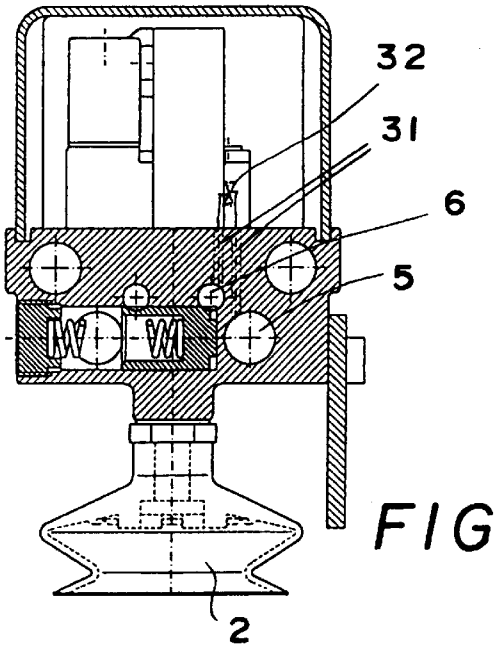
Figure 11:
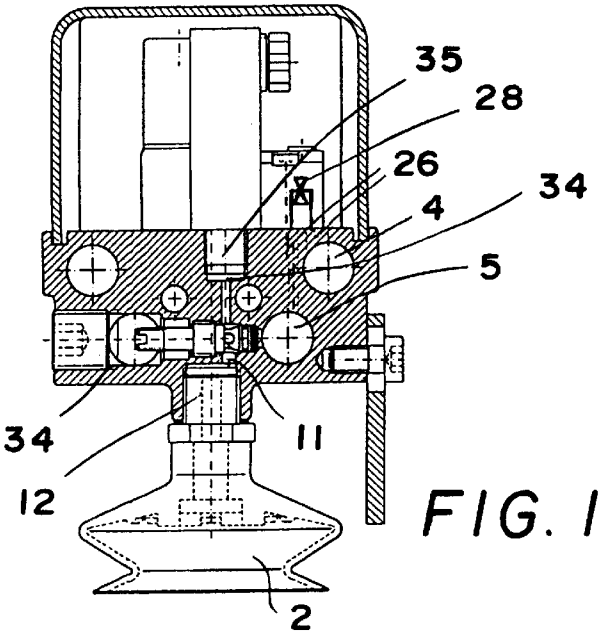
FIG. 11, is a section view along lines XI—XI through the sectional support in accordance with FIG. 10, and FIG. 12, is a section view along lines XII—XII through the sectional support in accordance with FIG. 10.

With the embodiment in FIGS. 10–12, the two conduits 4 and 5 are connected with each other via a connecting line 26, and the two conduits 5 and 6 via a connecting line 31. It is possible to divide the support beam 1 into discrete work sections 22 to 25 (FIG. 1) of different size by means of cut-off plugs. These sections 22 to 25 can have any arbitrary number of propellant nozzles 13. Thus it is possible, as described above, to purposefully aspirate objects independently of each other, and to again purposefully deposit objects independently of each other in the individual sections 22 to 25 by actuating the check valves 28 and 32. If the sectional support is divided into sections, the sections for aspirating and the sections for blowing-off can be of different sizes. Depending on the intended use, these sections can be arbitrarily combined.

Moreover, it can be seen in FIG. 11 that the connecting conduit 11 is connected with a stepped bore 34. A pressure sensor 35 has been installed in this stepped bore 34, by means of which the pressure in the suction connector 12, or respectively at the suction gripper 2, can be detected. When the sensor 35 has registered the desired vacuum, the check valve 28 is closed and the work circuit 5 is disconnected from the compressed air conduit 4 by this, so that no compressed air is used. As soon as the vacuum falls below a predetermined value, the check valve 28 is opened again and air is aspirated from the suction gripper 2 by means of the propellant nozzle 13. This sensor 35 can also be provided in each section and with the other embodiments.

As a whole it is possible to clearly see in the drawings that it is possible to achieve a relatively simple structure with relatively few components by employing an extruded section as the housing for the individual ejectors. Moreover, the extruded section is used as the support beam 1, by means of which the object(s) can be directly grasped and manipulated by the suction grippers 2. It is not necessary to dispose any interfering hose assemblies, or respectively any electrical lines, which freely move about. It is furthermore possible to connect the individual modules 29 and 33, as well as other electric components, to a bus system, so that the wiring outlay is further reduced.

What is claimed is:

1. An ejector for generating a vacuum, comprising:

a housing including an exhaust air conduit for pressure gas and exhaust air; and at least two propellant nozzles supported by said housing, said housing being arranged to provide sectional support for said at least two propellant nozzles, each propellant nozzle having a narrowed part, a diffuser section and a suction connector terminating in said narrow part.

2. The ejector as defined in claim 1, wherein said housing is extended to form said sectional support.

3. The ejector as defined in claim 2, wherein said extruded housing section has receivers, arranged in a guide pattern, for said at least two propellant nozzles.

4. The ejector as defined in claim 2, wherein said sectional support has at least one conduit.

5. The ejector as defined in claim 4, wherein said sectional support includes a compressed air conduit.

6. The ejector as defined in claim 5, further comprising:

a check valve, wherein said housing further including a connecting line in which said check valve is situated, and a work conduit connected with said at least two propellant nozzles, wherein said compressed air conduit is pneumatically connected via said connecting line with said work conduit.

7. The ejector as defined in claim 6, further comprising:

a further check valve, wherein said housing further including a blowoff conduit, and wherein said blow-off conduit is pneumatically connected via said further check valve with one of: said exhaust conduit, said work conduit, and said exhaust conduit and said work conduit.

8. The ejector as defined in claim 7, further comprising:

cut-off plugs, wherein said housing is divided into discrete, individually actuated sections by means of said cut-off plugs.

9. The ejector as defined in claim 5, further comprising:

a vacuum detecting sensor, which, as a function of the detected vacuum, connects said at least two propellant nozzles with said compressed air conduit.

10. The ejector as defined in claim 1, further comprising:

a plurality of suction connectors and suction grippers, each suction gripper being connected to a respective suction connector, wherein said housing comprises a support beam to which said suction connectors are connected.

11. The ejector as defined in claim 10, wherein said suction connectors are screwed into said support beam.

12. The ejector as defined in claim 7, further comprising:

a muffling device, said muffling device being provided in said blowoff conduit.

13. The ejector as defined in claim 12, wherein said muffling device comprises a foam material.

14. The ejector as defined in claim 8, wherein said discrete, individually actuated sections have an arbitrarily selectable size.

15. The ejector as defied in claim 8, wherein said discrete, individually actuated sections have one of: at least one propellant nozzle, at least one check valve, and at least one propellant nozzle and at least one check valve.

* * * * *